US005159738A

United States Patent [19]

Sunagawa et al.

[11] Patent Number: 5,159,738

[45] Date of Patent: Nov. 3, 1992

[54] VACUUM CLEANER HAVING SILENCER MECHANISM

[75] Inventors: Masao Sunagawa, Hitachi; Akira Iwao, Kitaibaraki, both of Japan

[73] Assignee: Hitachi, Ltd., Tokyo, Japan

[21] Appl. No.: 819,134

[22] Filed: Jan. 10, 1992

Related U.S. Application Data

[63] Continuation of Ser. No. 360,288, Jun. 2, 1989.

[30] Foreign Application Priority Data

Jun. 6, 1988 [JP] Japan ..... 63-137459

[51] Int. Cl.[5] ..... B01D 46/00; A47L 9/00

[52] U.S. Cl. ..... 15/326; 55/276; 55/372; 55/DIG. 3; 181/231

[58] Field of Search ..... 15/326, 327.2; 55/276, 55/372, DIG. 3, 326, 472; 181/231

[56] References Cited

U.S. PATENT DOCUMENTS

| | | | |
|---|---|---|---|
| 3,964,888 | 6/1976 | Hahner et al. | 55/276 |
| 4,050,913 | 9/1977 | Roach | 55/414 |
| 4,356,591 | 11/1982 | Lude | 15/326 |
| 4,533,370 | 8/1985 | Ikezaki et al. | 55/276 |
| 4,617,034 | 10/1986 | Ikezaki et al. | 55/276 |
| 4,733,429 | 3/1988 | Jacob et al. | 15/327.1 |
| 4,970,753 | 11/1990 | Herron, Jr. | 55/276 |

*Primary Examiner*—Harvey C. Hornsby
*Assistant Examiner*—Patrick F. Brinson
*Attorney, Agent, or Firm*—Antonelli, Terry, Stout & Kraus

[57] ABSTRACT

A blower cover is provided so as to surround an electric driven blower. The blower cover comprises an upper blower cover and a lower blower cover. An exhaust air duct as a silencer mechanism is provided on the upper blower cover and is disposed between a blower receiving chamber and a cord receiving chamber. The exhaust air duct comprising an outer peripheral wall portion and a side wall portion. The outer peripheral wall portion has a partitioning rib and a curved guiding rib. The exhaust air duct forms a U-shaped exhaust air flow passage. An expansion chamber is disposed air flow passage. An expansion chamber is disposed at a down stream of the exhaust air duct. The exhaust air from an intake port of the exhaust air duct flows the U-shaped flow passage and is led to the expansion chamber. The suctioned air is expanded in the blower receiving chamber. The exhaust air is compressed in the exhaust air duct and is expanded again in the expansion chamber.

17 Claims, 4 Drawing Sheets

VACUUM CLEANER HAVING SILENCER MECHANISM

This is a continuation of application Ser. No. 07/360,288, filed Jun. 2, 1999.

BACKGROUND OF THE INVENTION

The present invention relates to a vacuum cleaner having a silencer mechanism and, more particularly, to a vacuum cleaner having a resistance type silencer mechanism provided on a vacuum cleaner main body for flowing an exhaust air from an electric driven blower at an outside portion.

A conventional vacuum cleaner having a silencer mechanism is disclosed in, for example, Japanese Utility Model Laid-Open No. 115853/1987, wherein a vacuum cleaner main body of the vacuum cleaner provides a sound absorption box which is positioned between an electric driven blower receiving chamber and a cord winding apparatus receiving chamber. The sound absorption box has an intake port and a plurality of exhaust air ports.

As a result, a resonance type silencer mechanism for the vacuum cleaner main body is provided which is constituted between an outer peripheral surface portion of the sound absorption box and an inner wall portion of the vacuum cleaner main body.

Another construction is proposed in the above noted Japanese Utility Model Laid-Open No. 115853/1987 wherein a part flow from of an exhaust air flow from a side of an electric driven blower receiving chamber is bypassed through a part of the inner wall portion of the vacuum cleaner main body. Namely this inner wall portion of the vacuum cleaner main body is positioned between the electric driven blower receiving chamber and an exhaust air flow passage adjacent the electric driven blower receiving chamber.

However, in the vacuum cleaner having the resonance type silencer mechanism comprising the sound absorption box, the exhaust air flow from the side of the electric driven blower receiving chamber is exhausted into a comparatively large space portion in the vacuum cleaner main body via a plurality of exhaust air ports provided on the sound absorption box.

By this conventional vacuum cleaner structure, the exhaust air noise reduction effect which is a feature of the resonance type silencer mechanism can be attained, in other words the reduction of the exhaust air noise level at a particular frequency band can be attained.

However, in case of the exhaust air noise occurring in the vacuum cleaner main body, from the results of a frequency analysis, the peaks of the frequency of the exhaust air noise exist at a plurality of the frequency numbers in many cases. Therefore, the exhaust air noise reduction effect in the vacuum cleaner main body cannot be obtained sufficiently because of the vacuum cleaner having the resonance type silencer mechanism.

Further, the electric driven blower used in the vacuum cleaner adopts a commutator motor as a driving means for the blower and the rotational speed of the commutator motor varies in accordance with the variation of the load.

More particularly, at the initial condition in the cleaning operation of the vacuum cleaner in which the dust does not be suctioned into the vacuum cleaner main body, the rotational speed of the commutator motor is low and, generally in the range of 20,000–27,000 rpm.

When the dust is suctioned into the vacuum cleaner main body, the ventilation resistance in the vacuum cleaner main body increases so that the rotational speed of the commutator motor generally is in the range of 28,000–36,000 rpm.

Accordingly, the frequency number of the rotative vibrating exhaust air noise in accordance with the rotational speed of the commutator motor is variable. In the vacuum cleaner having the resonance type silencer mechanism, since only the exhaust air noise level at the particular frequency band can be reduced, the exhaust air noise reduction effect in the vacuum cleaner main body lowers the effectiveness of the vacuum cleaner.

Besides, in the conventional vacuum cleaner having the resonance type silencer mechanism structure, the vacuum cleaner adopts a structure in which a part flow of an exhaust air flow from the side of an electric driven blower receiving chamber, is bypassed through a portion of an inner wall of the vacuum cleaner main body. In other words, this inner wall portion of the vacuum cleaner main body is positioned between the electric driven blower receiving chamber and the exhaust air flow passage adjacent the electric driven blower receiving chamber.

In the above stated vacuum cleaner having the resonance type silencer mechanism structure, the exhaust air flow is not directly exhausted to the outside from the side of the electric driven blower receiving chamber, since the partial flow of the exhaust air flow is bypassed, the sound energy is converted to the heat energy during the passing through the exhaust air flow bypass passage in the vacuum cleaner main body.

Accordingly, an exhaust air noise reduction effect in the vacuum cleaner main body at some degree may be expected. However, in the above stated conventional vacuum cleaner having the resonance type silencer mechanism structure, since the length of the exhaust air flow passage is merely lengthened, the exhaust air noise passing through the vacuum cleaner main body remains large, therefore there has a room for improving from the aspect of the vacuum cleaner structure in which a sufficient silencing effect for the exhaust air in the vacuum cleaner main body can be obtained.

SUMMARY OF THE INVENTION

An object of the present invention is to provide a vacuum cleaner having a silencer mechanism wherein a sufficient silence effect in a vacuum cleaner main body for an exhaust air can be obtained.

Another object of the present invention is to provide a vacuum cleaner having a silencer mechanism wherein a noise reduction effect in a vacuum cleaner main body for an exhaust air can be obtained sufficiently.

A further object of the present invention is to provide a vacuum cleaner having a silencer mechanism wherein an exhaust air noise passing through in a vacuum cleaner main body can be generally reduced.

A further object of the present invention is to provide a vacuum cleaner having a silencer mechanism wherein a summarization for parts of a silencer mechanism of a vacuum cleaner main body can be easily attained.

A further object of the present invention is to provide a vacuum cleaner having a silencer mechanism which simplifies the assembly of the parts of a silencer mechanism of the vacuum cleaner.

In accordance with the present invention, a vacuum cleaner having a silencer mechanism comprises a vacuum cleaner main body, an electric driven blower receiving chamber for receiving an electric driven blower provided in the vacuum cleaner main body, and a cord winding apparatus receiving chamber for receiving a cord winding apparatus provided in the vacuum cleaner main body.

The vacuum cleaner main body further comprises an blower cover for surrounding the electric driven blower and an exhaust air duct provided between the blower cover and the cord winding apparatus receiving chamber. The exhaust air duct forms a resistance silencer type exhaust air flow passage for bypassing an exhaust air from a side of the electric driven blower receiving chamber surrounding the blower cover.

The exhaust air duct provided between the blower cover and the cord winding apparatus receiving room is formed integrally with the blower cover.

A sound absorption cover comprising a sound absorption material member is disposed between the blower cover and the blower with another sound absorption material member being arranged in an inner side wall of the exhaust air duct.

An expansion chamber is formed between an exhaust air port of the exhaust air duct and an exhaust air port of the vacuum cleaner main body. The expansion chamber has a cross-sectional area larger than a cross-sectional area of the exhaust air port of the exhaust air duct.

With a silencer mechanism constructed in accordance with the present invention, since the blower cover surrounds the outer peripheral portion of the blower for holding the blower, the vacuum cleaner main body has a double structure, accordingly the sound permeating the vacuum cleaner main body of the exhaust air noise which generates at the blower as the generating source for noise, can be reduced widely.

In addition to above stated structure, the exhaust air duct is provided between the blower cover and the cord winding apparatus receiving chamber. The exhaust air duct can form a resistance type silencer mechanism for the exhaust air flow passage in which the exhaust air flow bypasses from the side of the blower receiving chamber.

In the exhaust air flow from the side of the blower receiving chamber, since the sound energy of the exhaust air flow is converted to the heat energy during the time in tansit in the resistance type silencer mechanism for the exhaust air flow bypass passage, the exhaust air flow noise in the vacuum cleaner main body can be reduced widely.

In the field of noise level reduction, in comparison with the resonance type silencer mechanism, a resistance type silencer mechanism has been proposed which can reduce the noise level peaks at a plurality of the frequency bands. By this point, it is preferable to put the resistance type silencer mechanism into the vacuum cleaner main body and therefore the exhaust air noise at the vacuum cleaner main body can be widely reduced.

Further since the exhaust air duct, provided between the blower cover and the cord winding apparatus receiving chamber, is formed so as to be unitary with the blower cover thereby enabling a reduction in the number parts of the silencer mechanism for the vacuum cleaner main body.

Therefore, by virtue of the features of the present invention, it is possible to minimize the number of parts necessary to achieve a low noise realization for the exhaust air of a vacuum cleaner thereby supplying the assembly of the silencer mechanism while, at the same time, reducing the overall cost of the product.

Since the sound absorption cover comprising the sound absorption material member is disposed between the blower cover and the blower, an effective reduction for exhaust air noise can be attained. Since the sound absorption material member is placed along the inner side wall of the exhaust air duct, the reduction of exhaust air noise in the vacuum cleaner main body can be effectively attained.

The expansion chamber is provided between the exhaust air duct and the exhaust air port of the vacuum cleaner main body. Further the expansion chamber has a cross-sectional area larger than a cross-sectional area of the exhaust air port of the exhaust air duct.

By virtue of the last mentioned feature of the present invention the exhaust air from the blower is expanded in the blower receiving chamber and is thereafter compressed in the exhaust air duct. The exhaust air further is expanded again in the expansion chamber which is provided between the exhaust air port of the exhaust air duct and the exhaust air port of the vacuum cleaner main body. Accordingly, by this expansion effect and the compression effect by the resistance type silencer mechanism, the reduction effect for the exhaust air noise in the vacuum cleaner main body can be attained effectively.

DESCRIPTION OF THE INVENTION

Figure 1:
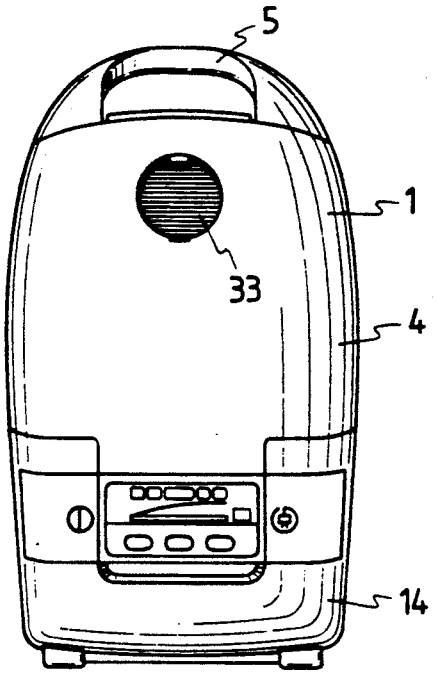
FIG. 1 is a top view of one embodiment of a vacuum cleaner main body having a silencer mechanism according to the present invention.
Figure 3:
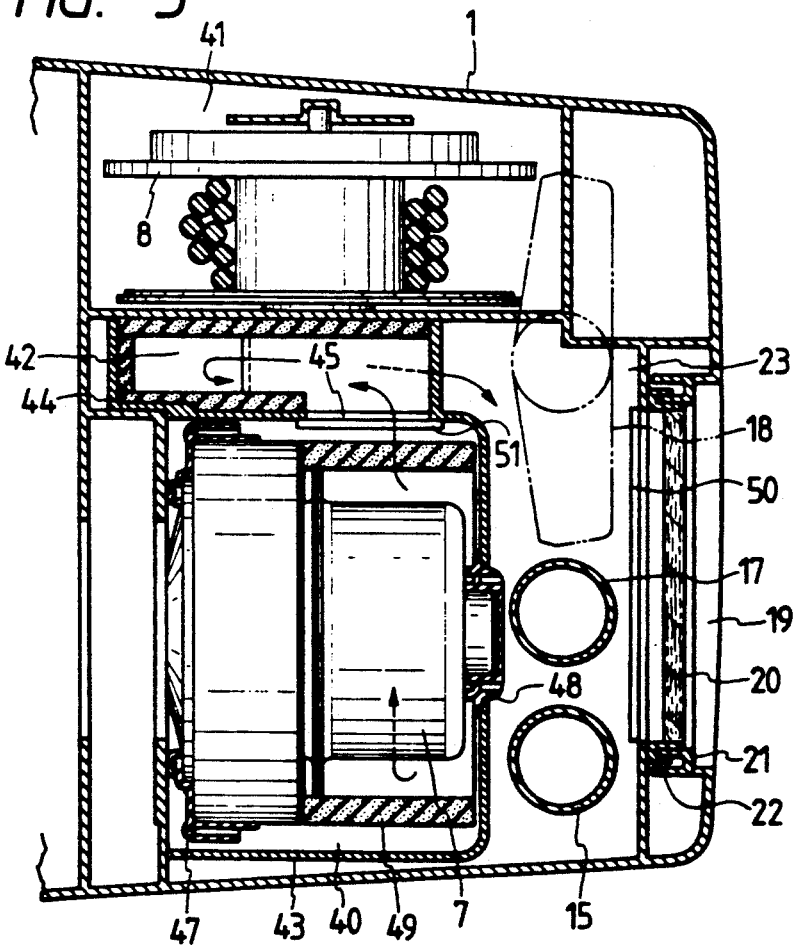
FIG. 3 is a horizontal cross-sectional view showing a partial portion of a vacuum cleaner main body having a silencer mechanism according to the present invention.
Figure 2:
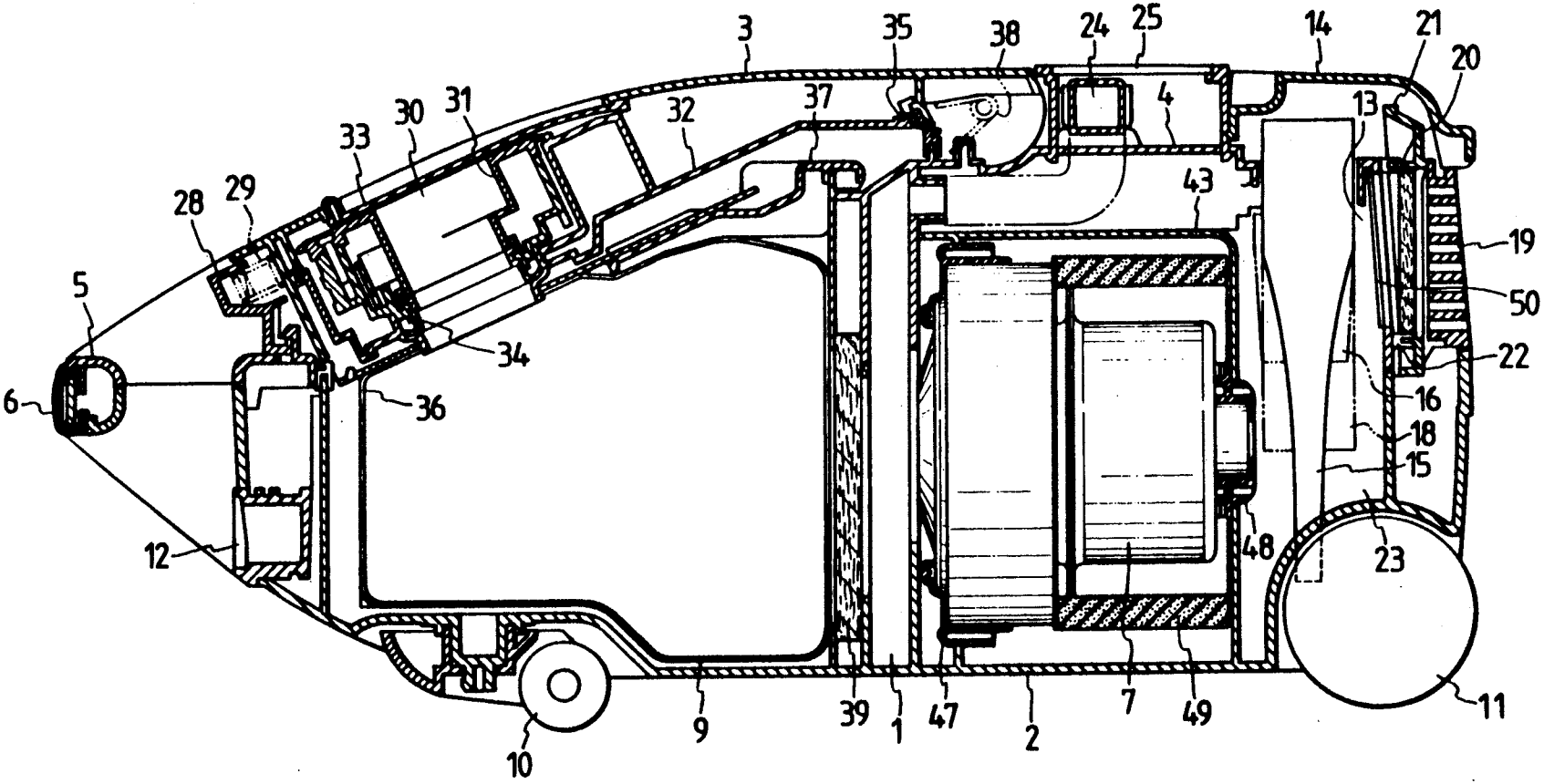
FIG. 2 is a vertical cross-sectional front view showing one embodiment of a vacuum cleaner main body having a silencer mechanism according to the present invention.
Figure 4:
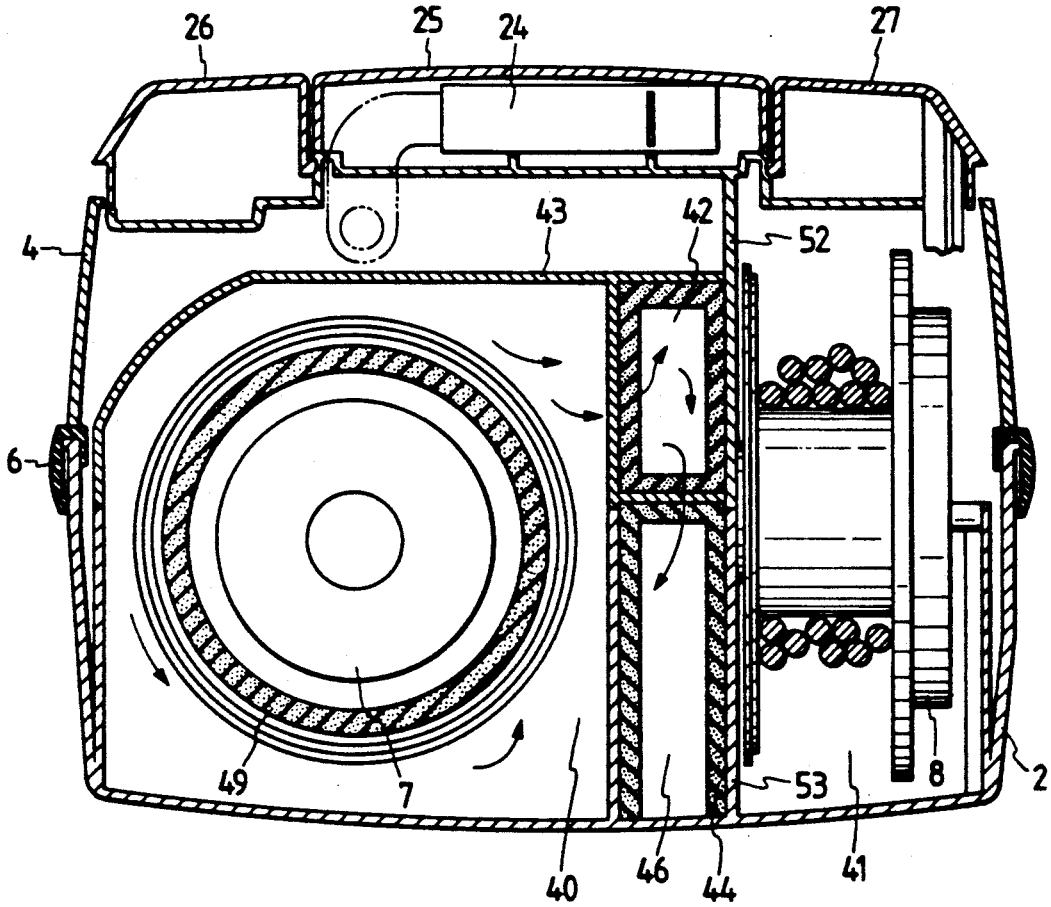
FIG. 4 is a cross-sectional side view showing a partial portion of a vacuum cleaner main body having a silencer mechanism according to the present invention.
Figure 5:
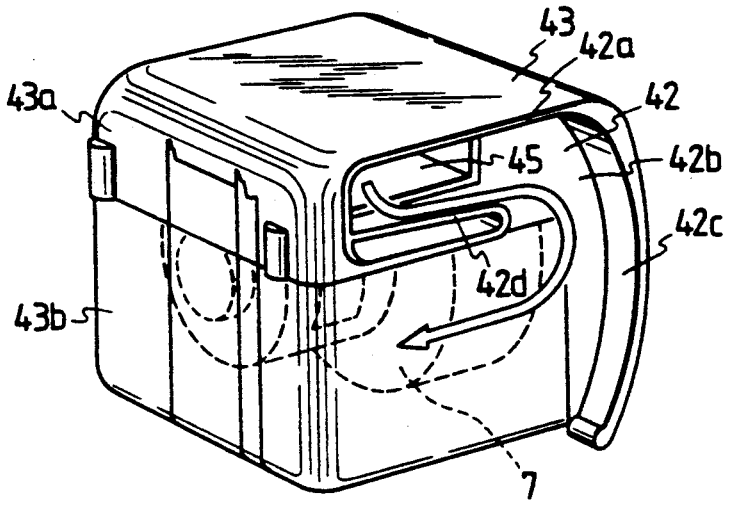
FIG. 5 is a perspective view of one embodiment of a blower cover of a vacuum cleaner main body having a silencer mechanism according to the present invention.
Figure 6:
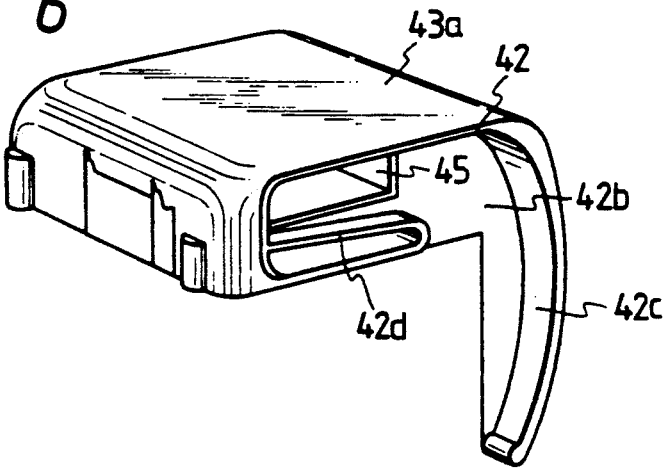
FIG. 6 is a perspective view of upper blower cover according to the present invention.
Figure 7:
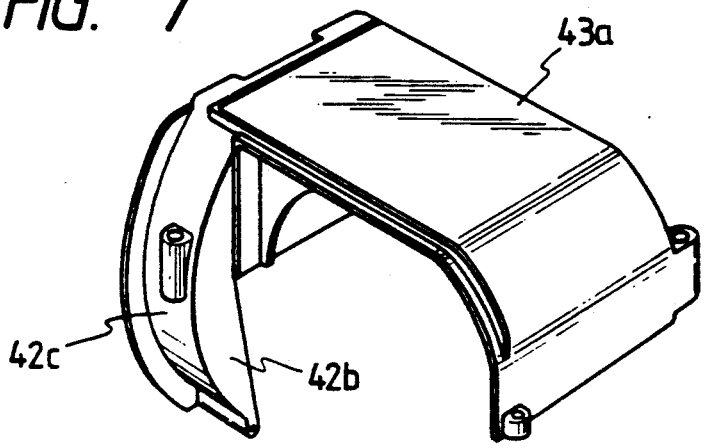
FIG. 7 is a perspective view of another upper blower cover according to the present invention.

Referring now to the drawings wherein like reference numerals are used throughout the various views to designate like figures, according to these figures, a flat type vacuum cleaner main body 1 of a vacuum cleaner having a silencer mechanism according to the present invention includes a lower main case 2, of a synthetic resin material, positioned at a lower portion of the vacuum cleaner main body 1, a dust collecting cover 3 positioned at an upper main case 4 made of a synthetic resin material and positioned at the upper portion of the vacuum cleaner main body 1, a handle portion 5 being positioned at a front portion of the vacuum cleaner main body 1, and a shock absorbing bumper member 6 being provided at an outer peripheral portion of the vacuum cleaner main body 1.

At an interior portion of the vacuum cleaner main body 1, an electric driven blower 7, a cord winding apparatus 8 and a dust collecting bag 9 etc. are installed therein. A caster 10 is provided at a front bottom portion of the lower main case 2, and two wheels 11 are provided at a rear bottom portion of the lower main case 2.

Further, a connecting portion 12 for enabling a connection of an extension pipe is provided at the front bottom portion of the lower main case 2 with a receiving portion 13 for accommodating various suction nozzles being provided at a rear upper portion of the upper main case 4. A lid 14 for opening or closing receiving portion 13 is mounted at an upper portion of receiving portion 13.

The suction nozzles may, for example, include a convergent nozzle 15 for cleaning the clearance, a suction nozzle 16 with a brush 17 at a tip thereof for shelf cleaning, and a T-shaped form suction nozzle 18 for cleaning the clothes.

A filter case 21 having an exhaust air filter member 20 is arranged between the receiving portion 13 and exhaust air port 19 and enable a free discharge of filtered air from the vacuum cleaner main body 1. The filter member 20 is constructed so as to trap dust therein by static electricity. A seal or packing member 22 is provided on an air tight state between the filter case 21 and the upper main case 4. A rectifying filter member 50 is provided at an opening portion of the vacuum cleaner main body 1 and is disposed at the front side of the filter case 21.

The receiving portion 13 is positioned between an exhaust air duct 42 and the exhaust air port 19 and has a comparatively wide cross-section so as to form an expansion chamber 23 for the exhaust air flow. More particularly, between an exhaust air port 46 of the exhaust air duct 42 and the exhaust air port 19. The expansion chamber 23 has a cross-sectional area larger cross-sectional area that of the exhaust air port 46.

A dust indicator 24 is provided at an upper portion of the main case 4 for a time for emptying the dust from the dust collecting bag 9. A cover 25 for covering an exterior of the dust indicator 24 is provided on the upper portion of the upper main case 4. A switch pedal 26 for operating a power source switch and a reel pedal 27 for operating the cord winding apparatus 8 are provided on respective sides of the cover 25.

At the front portion of the cover 3, a clamp 28 is supported by an elastic clamp spring member 29. A hose inserting port 30 is provided at an upper portion.

A portion 31 of the hose inserting port 30 is rotatably held by the cover 3 and a inner side lid 32 so as to rotatably a hose (not shown) inserted in the hose inserting portion 31. A hose inserting port cover 33 is provided an upper portion of the port 30 and closes the hose inserting port 30 when the vacuum cleaner is not in use.

Further at the hose inserting portion 31, an air-tight packing or sealing member 34 is provided for maintaining an air-tight state between the hose, inserted in the hose inserting portion 31 and the hose inserting port 30. A lid packing or seal member 35 is provided between the cover 3 and the inner side lid 32 and maintains at an air-tight state between the cover 3 and the inner side lid 32.

The dust collecting bag 9 is held by longitudinal ribs 36, provided on the lower main case 2 and by a filter stand member 37. The cover 3 is pivotably supported at the upper main case 4 and is elasticly bias the by a buffer spring member 38 during opening or closing of the cover 3. A secondary filter member 39 is mounted between the dust collecting bag 9 and the electric driven blower 7.

The electric driven blower 7 is received in an blower receiving chamber 40 and the cord winding apparatus 8 is received in a cord winding apparatus receiving chamber 41. The exhaust air duct 42 fashioned of a synthetic resin material is positioned between the receiving chamber 40 and the receiving chamber 41 and is arranged so as to introduce the exhaust air flowing from the side of the receiving chamber 40.

The receiving chamber 40 includes an inner wall portion of the lower main case 2 and an outer peripheral portion of a blower cover 43 of a synthetic resin material. The blower cover 43 includes an integrally formed exhaust air duct 42.

A sound absorption member 44 of a polyurethane foam material or the like is arranged at an inner side of the exhaust air duct. The exhaust air duct 42 has a U-shaped exhaust air flow passage and comprises an intake port 45 for introducing the exhaust air flow at an inlet portion thereof from the electric driven blower 7 and the exhaust air port 46 at an outlet portion thereof. A rectifying filter member 51 is provided at the front side of the intake port 45 and at disposed in the inner side of the blower cover 43.

Rubber cushion insulator members 47 and 48 are respectively provided at the front portion and the rear portion of the blower 7 a silencer cover 49, of a sound absorption material, is provided at the outer peripheral portion thereof.

The blower cover 43 comprises an upper blower cover 43*a* and a lower blower cover 43*b* with the upper blower cover 43*a* being received mainly in the upper main case 4 of the vacuum cleaner main body 1. The lower blower cover 43*b* is received in the lower main case 2 of the vacuum cleaner main body 1.

The upper blower cover 43*a* has a substantially box form with a downwardly semicircular opening at the front portion thereof with the lower blower cover 43*b* having a substantially box form with an upwardly semicircular opening at the front portion thereof.

With the two semicircular openings of the upper lower blower covers 43*a*, 43*b*, a substantially circular opening is provided for introducing a suctioned air flow from the dust collecting portion between the outer wall portion of the blower 7 and the inner wall portion of the blower cover 43. The upper blower cover 43*a* includes the intake port 45 having a rectangular opening for the exhaust air duct 42 at the rear upper portion thereof.

The exhaust air duct 42 comprises a side wall portion of the upper blower cover 43*a* having the intake port 45, an outer peripheral rib 42*a* projected toward the side of the receiving chamber 41, and a side wall portion rib 42*b* so as to form a U-shaped form exhaust air flow passage.

The rib 42*a* of the exhaust air duct 42 surrounds the outer peripheral portion upper blower cover 43*a* of the except for one front side part of the lower outer peripheral portion of the upper blower cover 43*a* and extends downwardly toward the side of the lower blower cover 43*b* rib 42*a* of the exhaust air duct 42 is integrally formed with the upper blower cover 43*a*.

The rib 42*b* extends toward the front side of both the upper and lower blower covers 43*a*, 43*b*. The rib 42*b* of the exhaust air duct 42 is formed integrally with the upper blower cover 43*a* in parallel with the side wall portions of the upper and lower blower covers 43*a*, 43*b*.

The exhaust air duct 42 further comprises a rectangularly shaped vertical rib 52 having a rectangle shaped form provided on the upper main case 4, and a rectangularly shaped vertical rib 53 provided on the lower main case 2. The exhaust air duct 42 is partitioned with two vertical ribs 52 and 53 of the vacuum cleaner main body 1 at the side of the receiving chamber 41 side.

The exhaust air duct 42 is formed at the side wall of the blower cover 43 and the side of the receiving chamber 41. Namely, the exhaust air duct 42 is formed between the outer side wall of the upper blower cover 43*a* and the outer side wall of the lower blower cover 43*b*.

The outer rib 42*a* of the exhaust air duct 42 has a partition rib 42*d* for partitioning the exhaust air flow and a guide rib 42*c* for guiding the exhaust air flow. The partition rib 42*d* is disposed directly under the intake port 45 of the exhaust air duct 42. The partition rib 42*d* is formed so as to partition the exhaust air flow in the exhaust air duct 42.

The partition rib 42*d* leads the exhaust air flow from the rear side of the vacuum cleaner main body 1 to the front side of the vacuum cleaner main body 1 at the side wall portion of the upper blower cover 43*a*. The partition rib 42*d* leads the exhaust air flow from the front side of the vacuum cleaner main body 1 to the rear side of the vacuum cleaner main body 1 at the side wall portion of the lower blower cover 43*b* 43.

The guide rib 42*c*, integrally formed with the outer peripheral wall portion rib 42*a*, has a curved portion so as to smoothly guide the exhaust air flow toward the downstream side in the exhaust air duct 42. The guide rib 42*c* projects and extends to the lower side of the upper blower cover 43*a*. The lowest portion of the guide rib 42*c* of the is positioned at the bottom portion of the lower blower cover 43*b*.

When the power source switch is activated, the suctioned air flows into the dust collecting portion and the outer peripheral portion of the blower 7 and is discharged into the receiving chamber 40.

Next, the exhaust air from the receiving chamber 40 flows into the intake port 45, in which the exhaust air from the blower 7 is introduced, and is compressed at the intake port 45 and further flows into the downstream side of the exhaust air duct 42.

The exhaust air is guided due to the U-shaped flow passage of the exhaust air duct 42. The exhaust air is led from the rear side of the vacuum cleaner main body 1 to the front side of the vacuum cleaner main body 1 along the side wall portion of the upper blower cover 43*a* by the outer peripheral wall portion rib 42*a* of the exhaust air duct 42 in cooperation with the partition rib 42*d* and the vertical rib 52.

The exhaust air is led form the upper side of the upper blower cover 43*a* to the lower side of the lower blower cover 43*b* by the guide rib 42*c* in cooperation with the side wall portion rib 42*b* and the vertical rib 52 of the upper main case 4.

The exhaust air is then led from the front side of the vacuum cleaner main body 1 to the rear side of the vacuum cleaner main body 1 along the side wall portion of the lower blower cover 43*b* in cooperation with the guide rib 42*c* and the vertical rib 53 of the lower main case 2.

The exhaust air flows into the expansion room 23 from the exhaust air port 46 of the exhaust air duct 42. The exhaust air from the lower blower cover 43*b* is led upwardly to the rear wall portions of the lower blower cover 43*b* and the upper blower cover 43*a*. After the exhaust air has been expanded in the expansion chamber 23, the exhaust air passes through the rectifying filter member 50 and the exhaust air filter member 20, and is then discharged from the exhaust air port 19.

Since the blower cover 43 holds the blower 7, the vacuum cleaner main body 1 has a double structure comprising the blower cover 43 and the upper main case 4. The vacuum cleaner main body 1 further has a triple structure comprising the cover 25, the lid 14, the blower cover 43 and the upper main case 4.

Accordingly the noise of exhaust air passing through the vacuum cleaner main body 1 generated at the blower 7, can be substantially reduced.

In addition to above stated structure, the exhaust air duct 42 is provided between the blower cover 43 and the receiving chamber 41. The exhaust air duct 42 forms a resistance type silencer mechanism for the exhaust air flow passage in which the exhaust air flow bypasses from the side of the receiving chamber 40.

In the exhaust air flow from the side of the receiving chamber 40, since the sound energy of the exhaust air flow is converted to the heat energy during the passing time in the resistance type silencer mechanism, the exhaust air noise in the vacuum cleaner main body 1 can be substantially reduced.

Further since the exhaust air duct 42, is formed as a unit with the electric driven blower cover 43, the assembly of the parts of the silencer mechanism of the vacuum cleaner main body 1 can be facilitated.

Therefore, increase in the number of elements necessary to achieve a realization low noise realization for the vacuum cleaner main body 1 can be minimized, and the assembly of the silence mechanism can be moreover, the overall manufacturing cost of resistance type silencer mechanism constructing in accordance with the present invention can be minimized.

Since the sound absorption cover 49 comprising the sound absorption material member is disposed between the blower cover 43 and the blower 7, the reduction effect for the exhaust air noise in the vacuum cleaner main body 1 can be effectively attained.

Furthermore, since the sound absorption material member 44 is put in the inner side of the exhaust air duct 42, the reduction effect for the exhaust air noise in the vacuum cleaner main body 1 can be attained effectively.

The exhaust air from the blower 7 is expanded in the receiving chamber 40 and is thereafter in the exhaust air duct 42 and is expanded again in the expansion chamber 23.

Accordingly, by this expansion effect and the compression effect by the resistance type silencer mechanism, a reduction in the exhaust air noise in the vacuum cleaner main body 1 can be effectively attained.

What is claimed is:

1. A vacuum cleaner having a silencer mechanism comprising:

a vacuum cleaner main body, a blower receiving chamber means for receiving an electric driven blower provided in said vacuum cleaner main body, a cord winding apparatus receiving chamber means for receiving a cord winding apparatus provided parallel to said blower receiving chamber means in said vacuum cleaner main body, a blower cover for surrounding said blower, an exhaust air duct forming an exhaust air flow passage for bypassing an exhaust air from a side of said blower receiving chamber means, and an expansion chamber means formed between said blower receiving chamber means and an exhaust air port of said vacuum cleaner main body, wherein said exhaust air duct comprises said blower cover a side wall portion of said cord winding apparatus receiving chamber means and a side wall portion of said blower receiving chamber means, said exhaust air duct is formed integrally with said blower cover, and wherein said exhaust air duct is provided between said blower receiving chamber means and said cord winding apparatus receiving chamber means, whereby the exhaust air exhausted from said blower receiving chamber means flows toward a front side once in said exhaust air duct and changes a direction toward a rear side in said exhaust air duct, and further flows into said expansion chamber means and is exhausted from said expansion chamber means through said exhaust air port of said vacuum cleaner main body.

2. A vacuum cleaner having a sensor mechanism according to claim 1, wherein a sound absorption cover comprising a sound absorption material member is disposed between said blower cover and said blower.

3. A vacuum cleaner having a silencer mechanism according to claim 1, wherein a sound absorption material member is disposed in an inner side of said exhaust air duct.

4. A vacuum cleaner having a silencer mechanism according to claim 1, wherein said expansion chamber means has a cross-sectional area larger than a cross-sectional area of an exhaust air port of said exhaust air duct.

5. A vacuum cleaner having a silencer mechanism comprising:

a vacuum cleaner main body having two main cases, an electric driven blower chamber means provided in said vacuum cleaner main body, a cord winding apparatus chamber means provided in said vacuum cleaner main body, a dust collecting apparatus provided in said vacuum cleaner main body, blower receiving chamber means for receiving said electric driven blower provided in said vacuum cleaner main body, a cord winding apparatus receiving chamber means being provided parallel to the blower receiving chamber means for receiving said cord winding apparatus provided in said vacuum cleaner main body, a blower cover surrounding said blower at an outer peripheral portion of said blower, an exhaust air duct disposed between said cord winding apparatus receiving chamber means and the blower receiving chamber means, said exhaust air duct forming an exhaust air flow passage for bypassing exhaust air from a side of said blower receiving chamber means to a side of an expansion chamber means formed between said blower receiving chamber means and an exhaust air port of said vacuum cleaner main body, wherein said exhaust air duct comprises said blower cover, a side wall portion of said cord winding apparatus receiving chamber means and a side wall portion of said blower receiving chamber means, and wherein said exhaust duct is integrally formed with said blower cover so that exhaust air exhausted from the blower receiving chamber means flows first in a direction toward a front side of said exhaust air duct, reverses a direction so as to flow toward a rear side of said exhaust air duct, and then flows into said expansion chamber means and is exhausted from said expansion chamber means through said exhaust air port.

6. A vacuum cleaner having a silencer mechanism according to claim 5, wherein a sound absorption cover comprising a sound absorption material member is disposed between said blower cover and said blower.

7. A vacuum cleaner having a silencer mechanism according to claim 5, wherein a sound absorption material member is arranged along an inner side of said exhaust air duct.

8. A vacuum cleaner having a silencer mechanism according to claim 5, wherein said expansion chamber means has a cross-sectional area larger than a cross-sectional area of an exhaust air port of said exhaust air duct.

9. A vacuum cleaner having a silencer mechanism comprising:

a vacuum cleaner main body having two main cases, an blower provided in said vacuum cleaner main body, a cord winding apparatus provided in said vacuum cleaner main body and being disposed at a side portion of said blower, a dust collecting apparatus provided in a front portion of said vacuum cleaner main body, blower receiving chamber means for receiving said blower provided in said vacuum cleaner main body, a cord winding apparatus receiving chamber means provided parallel to the blower receiving chamber means for receiving said cord winding apparatus a blower cover surrounding said blower at an outer peripheral portion of said blower, said blower, an exhaust air duct provided between said cord winding apparatus receiving chamber means and said blower receiving chamber means, and an expansion chamber means disposed between said blower receiving chamber means and an exhaust air port of said vacuum cleaner main body, said exhaust air duct forming an exhaust air flow passage for bypassing an exhaust air from a side of said blower receiving chamber means to a side of said expansion chamber means, wherein said exhaust air duct comprises said blower cover, a side wall portion of said cord winding apparatus receiving chamber means and a side wall portion of said blower receiving chamber means, and wherein said exhaust air duct is integrally formed with said blower cover whereby the exhaust air exhausted from said blower receiving chamber means flows first toward a front side of said exhaust air duct, reverses direction so as to flow to a rear side of said exhaust air duct, and then flows into said expansion chamber means and is exhausted from said expansion chamber means through said exhaust air port of said vacuum cleaner main body.

10. A vacuum cleaner having a silencer mechanism comprising:

a vacuum cleaner main body having two main cases, a blower provided in said vacuum cleaner main body, a cord winding apparatus provided in said vacuum cleaner main body and disposed at a side portion of said blower, a dust collecting apparatus provided in a front portion of said vacuum cleaner main body, a blower receiving chamber means for receiving said blower provided in said vacuum cleaner main body, a cord winding apparatus receiving chamber means, provided parallel to the blower receiving chamber means for receiving said cord winding apparatus an expansion chamber means formed at a rear portion of said blower receiving chamber means, a blower cover surrounding said blower at an outer peripheral portion of said blower, and an exhaust air duct provided between said cord winding apparatus receiving chamber means and the blower receiving chamber means, wherein said expansion chamber means is disposed between an exhaust air port of said exhaust air duct and an exhaust air port of said vacuum cleaner main body, wherein said exhaust air duct comprises said blower cover, a side wall portion of said cord winding apparatus receiving chamber means and a side wall portion of said blower receiving chamber means, wherein said exhaust air duct is formed integrally with said blower cover, said exhaust air duct forms an exhaust air flow passage for bypassing exhaust air from a side of said blower receiving chamber means to a side of said expansion chamber means so that the exhaust air exhausted from said blower receiving chamber means flows first toward a front side of said exhaust air duct, reverses a direction and flows toward a rear side of said exhaust air duct, and further flows into said expansion chamber means and is exhausted from said expansion chamber means through said exhaust air port of said vacuum cleaner main body.

11. A vacuum cleaner having a silencer mechanism according to claim 10, wherein said expansion chamber means has a cross-sectional area larger than a cross-sectional area of an exhaust air port of said exhaust air duct.

12. A vacuum cleaner having a silencer mechanism comprising:

a vacuum cleaner main body having an upper main case and a lower main case, a blower provided between said upper main case and said lower main case, a cord winding apparatus provided between said upper main case and said lower main case and disposed at a side portion of said blower, a dust collecting apparatus provided between said upper main case and said lower main case of a front portion of said vacuum cleaner main body, a blower receiving chamber means for receiving said blower provided between said upper main case and said lower main case, a cord winding apparatus receiving chamber means disposed parallel to the blower receiving chamber means for receiving said cord winding apparatus between said upper main case and said lower main case and disposed at a side portion of said blower receiving chamber means, an expansion chamber means provided at a rear portion of said blower receiving chamber means, a blower cover surrounding said blower at an outer peripheral portion of said blower, and an exhaust air duct disposed between said cord winding apparatus receiving chamber means and said blower receiving chamber means, wherein said exhaust air duct comprises an intake port for communicating said blower receiving chamber means and an exhaust air port communicating with said expansion chamber means, said expansion chamber means is disposed between an exhaust air port of said exhaust air duct and an exhaust air port of said vacuum cleaner main body, said exhaust air duct comprises said blower cover, a side wall portion of said cord winding apparatus receiving chamber means and a side wall portion of said blower receiving chamber means, wherein said exhaust air duct is formed integrally with said blower cover, and wherein said exhaust air duct forms an exhaust air flow passage for bypassing exhaust air from a side of said blower receiving chamber means to a side of said expansion chamber means such that exhaust air from said blower receiving chamber means flows first toward a front side of said exhaust air duct, reverses direction and flows to a rear side of said exhaust air duct, and further flows into said expansion chamber means and is exhausted from said expansion chamber means through said exhaust air port of said vacuum cleaner main body.

13. A vacuum cleaner having a silencer mechanism according to claim 12, wherein said exhaust air flow passage in said exhaust air duct is formed with a flow passage bypassing from said intake port of said exhaust air duct to said exhaust air port of said exhaust air duct in a U-shaped form.

14. A vacuum cleaner having a silencer mechanism according to claim 13, wherein said exhaust air duct comprises a partitioning rib and a guiding rib, said partitioning rib partitions the exhaust air flow from a rear side of said exhaust air duct to a front side of said exhaust air duct at an upper portion of said exhaust air duct and further the exhaust air flow from the front side of said exhaust air duct to the rear side of said exhaust air duct at a lower portion of said exhaust air duct, said guiding rib guides the exhaust air flow from an upper side of said exhaust air duct to a lower side of said exhaust air duct, and said partitioning rib leads the exhaust air flow passing through said guiding rib from the front side of said exhaust air duct to the rear side of said exhaust air duct whereby the exhaust air is bypassed in the U-shaped form from said intake port of said exhaust air duct to said exhaust air port of said exhaust air duct.

15. A vacuum cleaner having a silencer mechanism according to claim 14, wherein each of said partitioning rib and said guiding rib is respectively integrally formed with said blower cover.

16. A vacuum cleaner having a silencer mechanism according to claim 15, wherein said blower cover comprises an upper blower cover and a lower blower cover, and each of said partitioning rib and said guiding rib is respectively integrally formed with said upper blower cover.

17. A vacuum cleaner having a silencer mechanism according to claim 16, said guiding rib wherein extends downwardly toward

* * * * *